United States Patent [19]

Spencer

[11] Patent Number: 5,026,302

[45] Date of Patent: Jun. 25, 1991

[54] CONNECTOR

[75] Inventor: Mark Spencer, Maricopa, Ariz.

[73] Assignee: W. L. Gore & Associates, Inc., Newark, Del.

[21] Appl. No.: 535,795

[22] Filed: Jun. 8, 1990

[51] Int. Cl.[5] ..... H01R 13/00

[52] U.S. Cl. ..... 439/573; 439/578

[58] Field of Search ..... 439/578–585, 439/571, 573

[56] References Cited

U.S. PATENT DOCUMENTS

| | | | |
|---|---|---|---|
| 2,694,187 | 11/1954 | Nash | 439/578 |
| 3,976,352 | 8/1976 | Spinner | 439/578 |
| 4,099,825 | 7/1978 | Jackson | 439/578 |

*Primary Examiner*—Joseph H. McGlynn

*Attorney, Agent, or Firm*—Gary Samuels

[57] ABSTRACT

The use of a connector with an axially movable coupling interface prevents cracking when it is connected to a hermetically sealed electronic device in which the hermetic seal is provided by a glass or ceramic feed through.

2 Claims, 2 Drawing Sheets

CONNECTOR

FIELD OF THE INVENTION

This invention relates to a flexible electrical connector for mating cable to a flat or planar surface on a companion component, especially a companion component that is hermetically sealed with glass or ceramic.

BACKGROUND OF THE INVENTION

Radio frequency (RF) connectors are commonly used to mate and connect planar circuits to coaxial systems. Frequently, the mating will be with equipment in which the planar circuit has a hermetically sealed feed-through pin molded into the center of a glass or ceramic material component. Frequently, too, the planar circuit will have a metal ring serving as an outer conductor around the circumference of the glass or ceramic. When mating to such components there are both electrical and mechanical performance characteristics to consider. In order to achieve maximum electrical performance the outer conductor, which is usually the connector body, should mate directly against the outer conductor ring of the hermetic feed through. Difficulty is sometimes encountered when the connector is tightened against the component because pressure is exerted on the feed through outer conductor causing micro-cracks in the glass or ceramic material which degrades the hermetic performance of the seal. Another problem is caused by temperature gradients; for when components and connectors, in their mated state, are subjected to temperature cycling the difference in expansion coefficients between materials in the feed through and the connector cause excessive pressure on the feed through and again micro-cracks result.

SUMMARY OF THE INVENTION

The deficiencies described above are overcome in this invention by providing an axially movable coupling interface in the connector that couples with the hermetically sealed surface.

DESCRIPTION OF THE INVENTION

The invention provides an axially movable resilient interface which allows mating of a connector directly against the glass or ceramic of the hermetic seal. It is difficult to provide an effective contact without cracking the glass or ceramic at the interface or without degrading the electrical performance of the system.

Figure 1:
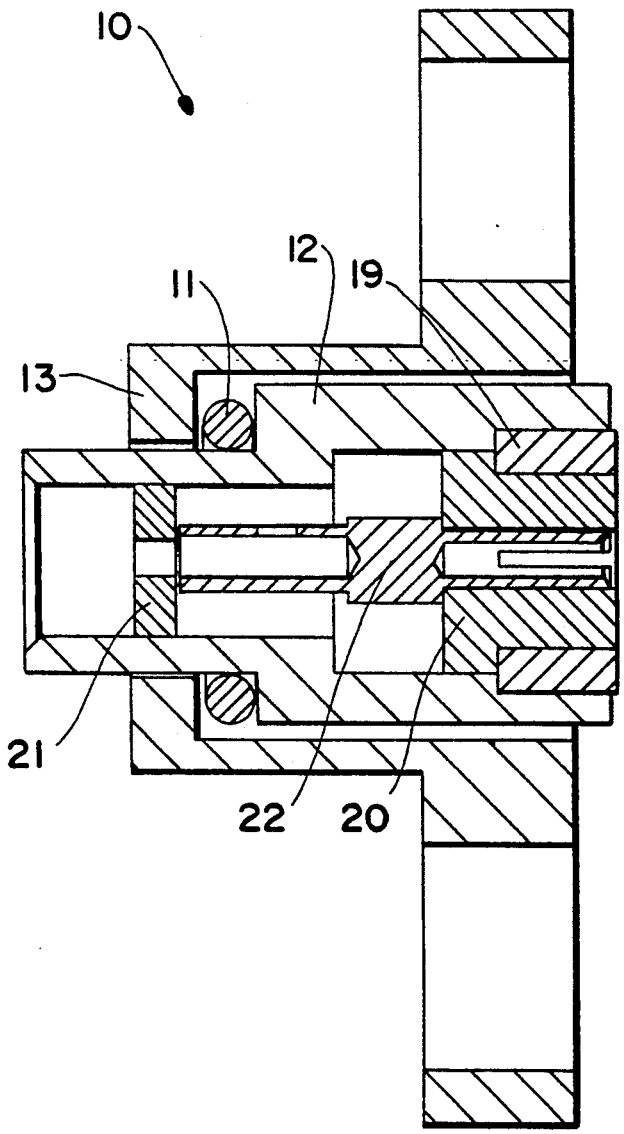
FIG. 1 depicts a cutaway side view of the connector of the invention.
Figure 2:
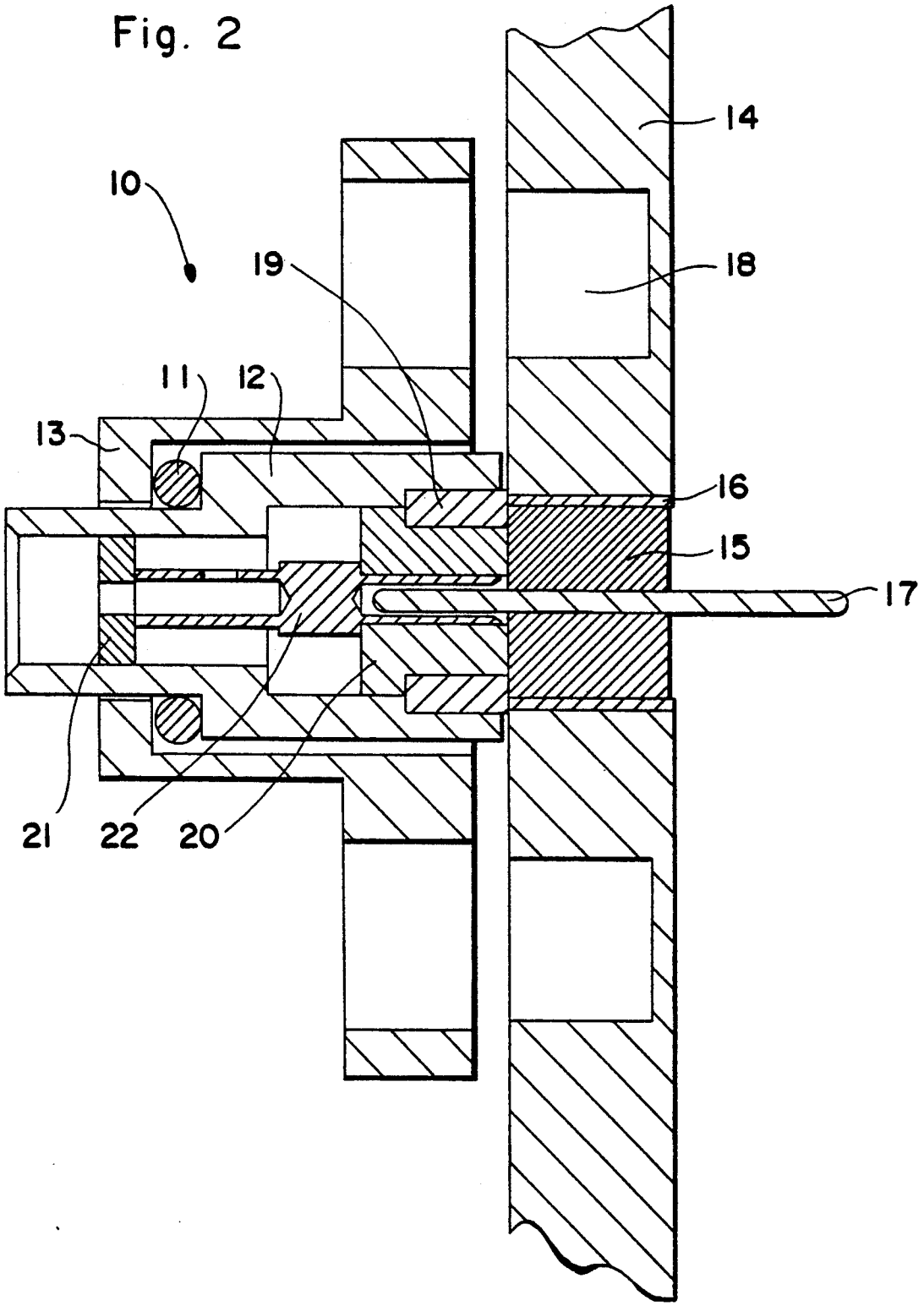
FIG. 2 depicts the same connector in cutaway view but shows the connector interfacing with a hermetically sealed electronic box.

In FIGS. 1 and 2, the axially movable interface in the connector 10 is provided by placing a compressible spring-action material 11 between the connector body 12 and a clamping flange 13. The clamping flange 13 of connector 10 is applied against the wall 14 (FIG. 2) of an electronic device which contains a glass or ceramic inteface 15 (FIG. 2) and an outer feed through conductor ring 16 and a central feed through pin 17 (FIG. 2). When clamping flange 13 is tightened against wall 14 of the electronic device by tightening nuts in receptacle 18, the resulting force causes the entire connector interface assembly to move axially back against compressible spring-action material 11. This axial action relieves pressure on the glass or ceramic interface 15 and prevents it from cracking while maintaining good electrical contact.

The connector interface assembly is composed of the conductor body 12, outer conductor ring 19, annular insulation 20 at the interface end of body 12, annular insulation 21 at the opposite end of body 12, and conducting pin 22.

In general, the entire construction of the connector of the invention will be the usually annular configuration from front to back. In one embodiment, the insulation 20 and 21 will be made of polytetrafluoroethylene, the connector outer ring 19 of stainless steel, the connector body of brass, the conductive pin 22 of beryllium/copper, and the compressible spring action material 11 will be an O-ring constructed of Viton® polymer.

In one embodiment, the connector 10 comprises;

an annular connector body 12 which defines a cavity having two opposing openings;

one said opening adapted to receive an electrical cable;

a conductive pin 22 located in the connector body and constructed and positioned to extend from one said opening to the other, said pin adapted to contact the electrical conductors of said cable and to mate with an external connecting face;

an outer annular conductor ring 19 positioned to contact a like ring in the opposing surface companion component;

a retaining wall or flange 13 attached to body 12 in a manner that defines a space for receiving an annular ring of compressible material;

an annular compressible material 11 positioned in said space.

I claim:

1. A connector for mating an electrical cable to an opposing hermetically sealed glass or ceramic surface containing an electrical contact, wherein the electrical assembly in the connector is axially movable against a compressible, spring action member located behind the electrical assembly to provide a cushion that prevents deterioration of the glass or ceramic hermetic seal as the connector and hermetic seal are tightened against one another.

2. A connector for mating an electrical cable to an opposing glass or ceramic surface that contains a feed-through pin 17 and outer conductor 16, said connector comprising:

(a) an annular connector body 12, (b) an opening in one end of said body adapted for receiving an electrical cable;

(c) an opening in the other end adapted for interfacing with said opposing surface;

(d) a conductive pin 22 located in connector body 12 and constructed and positioned to extend from one opening to the other, said pin adapted to contact the electrical conductor of said cable and to mate with said opposing surface;

(e) insulative bodies 20 and 21 located in said openings to support and protect said pin 22;

(f) an outer annually conductor ring 19 abutting said body 12 positioned to mate with a like ring in the opposing surface;

(g) an annular compressive material positioned behind and abutting the connector body 12 and in front of a retaining wall 13 that is in fixed relationship to the body 12.

* * * * *